US007654665B2

(12) United States Patent
Gray et al.

(10) Patent No.: US 7,654,665 B2
(45) Date of Patent: Feb. 2, 2010

(54) INK JET PEN HAVING A FREE INK CHAMBER

(75) Inventors: Trevor Daniel Gray, Midway, KY (US); Bhaskar Ramakrishnan, Lexington, KY (US); Jerry Earl Stokesbary, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 304 days.

(21) Appl. No.: 11/241,219

(22) Filed: Sep. 30, 2005

(65) Prior Publication Data

US 2007/0076083 A1 Apr. 5, 2007

(51) Int. Cl.
*B41J 3/36* (2006.01)

(52) U.S. Cl. ..... 347/109; 346/143; 400/88

(58) Field of Classification Search ..... 347/109; 346/143; 400/88

See application file for complete search history.

(56) References Cited

U.S. PATENT DOCUMENTS 4,412,232 A * 10/1983 Weber et al. ..... 347/68
4,999,016 A * 3/1991 Suzuki et al. ..... 400/88
5,311,208 A * 5/1994 Burger et al. ..... 345/163
5,501,535 A * 3/1996 Hastings et al. ..... 400/88
5,742,308 A * 4/1998 Cowger et al. ..... 347/85
6,022,102 A * 2/2000 Ikkatai et al. ..... 347/85
6,296,354 B1 * 10/2001 Hashimoto ..... 347/87
6,357,939 B1 * 3/2002 Baron ..... 400/88
6,394,598 B1 * 5/2002 Kaiser ..... 347/109
6,536,972 B2 * 3/2003 Bramlett et al. ..... 401/16
6,846,077 B2 * 1/2005 Bich et al. ..... 347/109
2002/0071012 A1 * 6/2002 Breemes et al. ..... 347/86
2003/0043240 A1 * 3/2003 Dowell ..... 347/85
2005/0157129 A1 * 7/2005 Merz et al. ..... 347/87

FOREIGN PATENT DOCUMENTS

JP 2000246914 A * 9/2000

* cited by examiner

*Primary Examiner*—Stephen D Meier
*Assistant Examiner*—Leonard S Liang

(57) ABSTRACT

An ink jet pen that is equipped with a free ink chamber. The ink jet pen has a free ink chamber in fluid communication with a negative pressure producing chamber. The negative pressure producing chamber is in communication with a printhead. The ink jet pen has a power source and a surface detection device. The surface detection device is adapted to move along a surface of the substrate.

19 Claims, 2 Drawing Sheets

INK JET PEN HAVING A FREE INK CHAMBER

TECHNICAL FIELD

The present invention relates to a hand-held ink jet pen, and more specifically to an ink jet pen having a free ink chamber adapted to increase the yield capacity of the ink jet pen.

BACKGROUND OF THE INVENTION

Ink jet printing is a conventional technique by which printing is accomplished without contact between the printing apparatus and the substrate, or medium, on which the desired print characters are deposited. Such printing is accomplished by ejecting ink from an ink jet printhead of the printing apparatus via numerous methods which employ, for example, pressurized nozzles, electrostatic fields, piezo-electric elements and/or heaters for vapor phase droplet formation.

Recently there has been a desire for a hand-held printer, which utilizes the same ink jet printing technology. One embodiment of this hand-held printer is an ink jet pen. The ink jet pen utilizes a printhead to deposit ink on a substrate rather than utilizing a conventional ballpoint roller or felt tip marker of a conventional pen. A user of the ink jet pen activates the pen to begin writing and moves the ink jet pen in a similar motion as a user would move a conventional pen to deposit ink on the substrate. It is desired that the ink jet pen be similar in shape and/or size to a conventional pen to allow the user to efficiently and effectively use the ink jet pen for writing. Accordingly, the conventional components of ink jet printing must be miniaturized to fit in the conventional long and slender shape of a pen.

Thus, ink reservoirs of the hand-held ink jet pen differ from conventional ink jet printer cartridge ink reservoirs in their shape and size. Since the size of the ink jet pen is desired to be limited, the overall efficiency of the ink jet system is desired to be increased. One potential drawback of a long and slender reservoir is that it deviates from the spherical shape which theoretically holds the largest amount of ink for a small surface area. One solution known in the art to attempt to overcome this opportunity for improvement is to increase the efficiency of the reservoir material which produces a negative pressure to avoid drooling of the ink. However, there potentially remains a substantial quantity of ink stranded in the reservoir material which can affect the page yield of the ink reservoir and therefore the overall efficiency of the ink jet pen. As such, there is a need for an ink jet pen with increased efficiency in overall yield from the ink reservoir. Accordingly, improved ink jet pens are desired.

SUMMARY OF THE INVENTION

The present invention relates to an ink jet pen having a free ink chamber. One aspect of the present invention is an ink jet pen. The ink jet pen comprises a free ink chamber adapted to contain ink; a negative pressure producing chamber in fluid communication with the free ink chamber. The negative pressure producing chamber is adapted to contain ink and contains at least a portion of a negative pressure producing material. The ink jet pen further includes a printhead in fluid communication with the negative pressure producing chamber; a power source; and a surface detection device. The surface detection device adapted to move along a surface of a substrate.

The ink jet pens of the present invention are advantageous for providing an ink jet pen having increased page yield and overall efficiency. These and additional advantages will be apparent in view of the detailed description.

BRIEF DESCRIPTION OF THE DRAWINGS

While the specification concludes with claims particularly pointing out and distinctly claiming the present invention, it is believed the same will be better understood from the following description taken in conjunction with the accompanying drawings in which:

DETAILED DESCRIPTION OF THE INVENTION

Reference will now be made in detail to various embodiments which are illustrated in the accompanying drawings, wherein like numerals indicate similar elements throughout the views.

Figure 1:
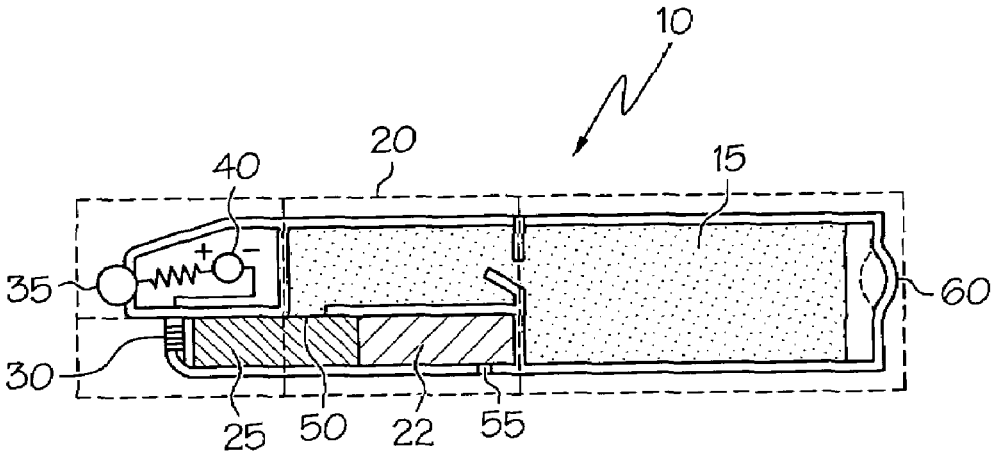
FIG. 1 is a schematic illustration of an exemplary ink jet pen according to a first embodiment of the present invention.

One embodiment of the present invention is illustrated in FIG. 1. In this embodiment, the ink jet pen 10 comprises a free ink chamber 15 adapted to contain ink. The ink jet pen 10 further comprises a negative pressure producing chamber 20 in fluid communication with the free ink chamber 15. The negative pressure producing chamber 20 is adapted to contain ink. At least a portion of the negative pressure producing chamber 20 is filled with a negative pressure producing material. Exemplary negative pressure producing materials include polyurethane foams, polyester, polypropylene, polyethylene, or combinations thereof. The ink jet pen 10 further includes a printhead 30 in fluid communication with the negative pressure producing chamber 20. The ink jet pen 10 also comprises a surface detection device 35, wherein the surface detection device is adapted to move along a surface of a substrate. In one exemplary embodiment, the surface detection device 35 is in communication with a power source 40, wherein the power source 40 is configured to activate the printhead 30 when the surface detection device 35 detects movement at or near the surface of a substrate.

In one exemplary embodiment of the present invention, at least a portion of the free ink chamber 15 is removable from the ink jet pen 10. For example, ink reservoirs can be interchangeable, which allows replacement ink or different colors or types of ink to be jetted by the ink jet pen. In another exemplary embodiment, the negative pressure producing chamber 20 may further comprise at least one supplemental free ink chamber. The ink in the supplemental free ink chamber flows through a communication port 50 to reach the negative pressure producing chamber and subsequently the printhead 30.

In one exemplary embodiment of the present invention, an air vent 55 is located in the negative pressure producing chamber 20. The air vent's 55 placement is configured such as to provide for a flow of ink first from the negative pressure producing chamber and then at a predetermined level establish an air flow path to the free ink chamber, thereby allowing ink in the free ink chamber to pass through the communication port 50 into the negative pressure producing chamber 20. As ink in the negative pressure producing chamber 20 is depleted, an air path is established between the air vent 55 and the communication port 50. The air path allows ambient air to bubble or pass into the free ink chamber and reduce the negative pressure in the negative pressure port chamber 20. The free ink from the free ink chamber then flows into the negative pressure producing chamber and will eventually cut off this air path. Until the ink level in the negative pressure producing chamber is reduced to establish the air path to the communication port, the free ink will not flow out from the free ink chamber This process is repeated until all the ink in the ink reservoir is depleted.

In another exemplary embodiment, the negative pressure producing chamber may be divided into two regions 22 and 25. For example, region 22 located away from the nozzle may be unsaturated. Region 22 would be saturated when the free ink is forced out into the negative pressure producing chamber due to pressure differences caused by atmospheric pressure changes such as during storms or altitude changes. In the exemplary embodiment illustrated in FIG. 1, the negative pressure producing chamber 20 further comprises a portion of low density felt 22 and a higher density felt 25. In one exemplary embodiment, the air vent in the negative pressure producing chamber is covered with a venting material that would present ink from exiting the pen in an unwanted fashion. Exemplary materials for the vent may include expanded polytetraflouroethylene, hydrophobically treated nylon, polyester, polypropylene, acrylic, or combinations thereof.

In yet another exemplary embodiment, the ink jet pen 10 further comprises a diaphragm or bellows 60 located on a free ink chamber 15. The diaphragm or bellows 60 is adapted to help aid in establishment of a prime of the nozzles with ink. As the bellows 60 are depressed by the user, the printing liquid is pressurized through the negative pressure producing materials. This, in turn, applies pressure to the ink jet nozzles, which purges the system of trapped air bubbles. When released, the bellows 60 retract to the original position, pulling air from the air vent 55. The bellows 60 can be made of flexible plastics, metallic, rubber and the like.

In one exemplary embodiment of the present invention, the free ink chamber 15 is sealed to the negative pressure producing chamber 20. In this embodiment, the sealed free ink chamber 15 and negative pressure producing chamber 20 could be replaceable together as one entity into the ink jet pen 10. In an alternative embodiment, the ink jet pen 10 is configured such that the free ink chamber 15 can be removed from the negative pressure producing chamber, wherein allowing replacement of the free ink chamber.

Figure 5:
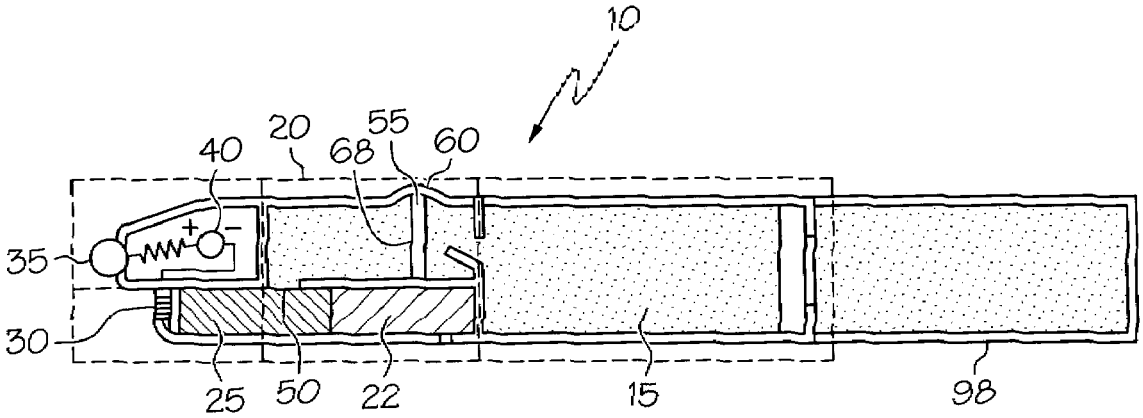
FIG. 5 is a schematic illustration of an exemplary ink jet pen according to a fifth embodiment of the present invention The embodiments set forth in the drawings are illustrative in nature and not intended to be limiting of the invention defined by the claims. Moreover, individual features of the drawings and the invention will be more fully apparent and understood in view of the detailed description.

In another exemplary embodiment, illustrated in FIG. 5, the free ink chamber 15 is adapted to connect to an auxiliary ink tank 98. The auxiliary ink tank 98 is adapted to contain ink and could allow additional quantities of ink to be utilized by the ink jet pen 10. In this embodiment, the free ink chamber 15 may or may not be replaceable. For example, the free ink chamber 15 may not be replaceable but additional ink quantities can be added to the pen utilizing an auxiliary ink tank. For example, in one embodiment, the auxiliary ink tank 98 is adapted to connect to the free ink chamber 15 such that the auxiliary ink tank 98 is in fluid communication with the free ink chamber 15.

In another exemplary embodiment, the ink jet pen 10 further comprises a housing, wherein the housing is adapted to contain at least a portion of the power source, free ink chamber and the negative pressure producing chamber. In yet another exemplary embodiment, the free ink chamber 15 further comprises an ink sensor adapted to alert a user of ink quantity remaining in the free ink chamber. Sensors for detecting ink presence and/or ink levels are known in the art. In an illustrative embodiment, the sensor is an optical device that uses an infrared signal to detect a presence or absence of ink.

Figure 2:
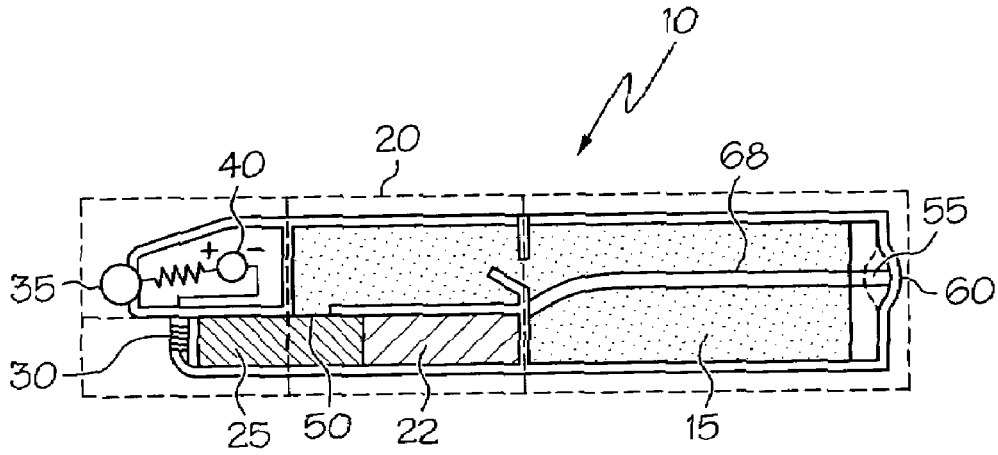
FIG. 2 is a schematic illustration of an exemplary ink jet pen according to a second embodiment of the present invention.

Another exemplary embodiment of the present invention is illustrated in FIG. 2. In this embodiment, the air vent 55 is located in the free ink chamber 15. A flexible tube 68 connects the air vent 55 to the negative pressure producing chamber 20 in order to decrease the chance of ink coming out of the vent during use by the consumer. The air vent 55 in one exemplary embodiment is covered by the user when the diaphragm or bellows 60 is utilized. In this embodiment, the seal between the free ink chamber 15 and the negative pressure producing chamber 20 is configured in such a way to connect the flexible tubing 68 to the negative pressure producing chamber 20. For instance, sockets or other connection means known to one skilled in the art can be utilized.

Figure 3:
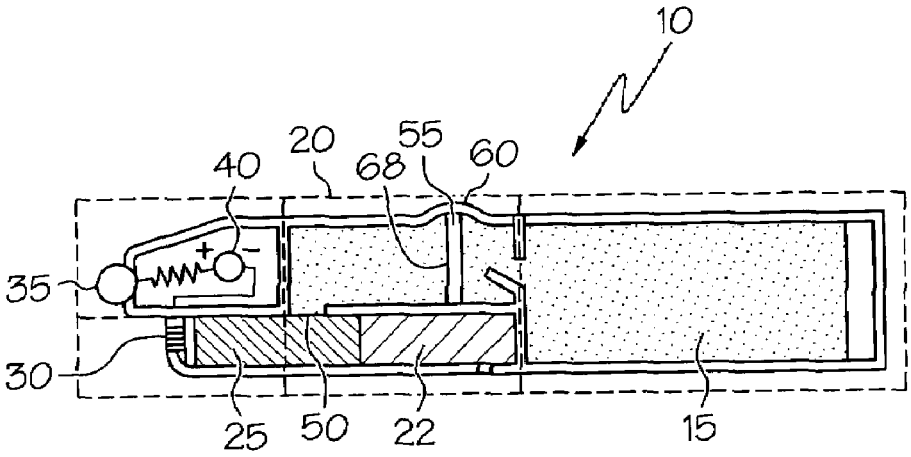
FIG. 3 is a schematic illustration of an exemplary ink jet pen according to a third embodiment of the present invention.
Figure 4:
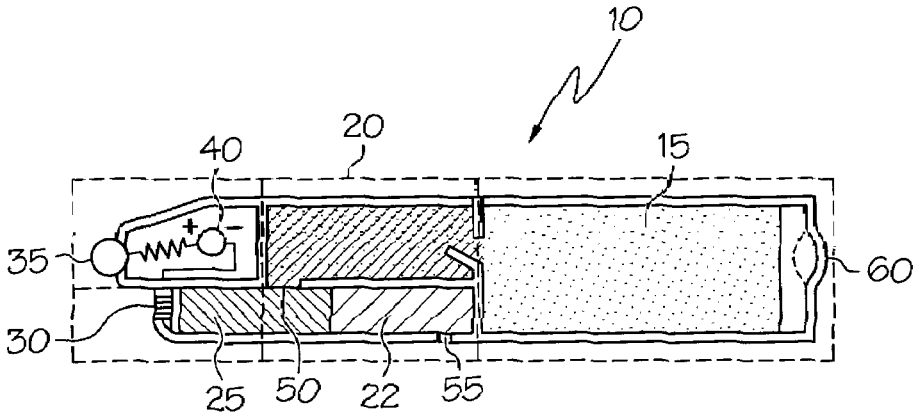
FIG. 4 is a schematic illustration of an exemplary ink jet pen according to a fourth embodiment of the present invention.

Yet another embodiment of the present invention is illustrated in FIG. 3. In this embodiment, the air vent 55 is located in the negative pressure producing chamber 20. In this embodiment, the flexible tube 68 connects the air vent 55 to the low density felt portion 22 of the negative pressure producing chamber 20. This embodiment can minimize the complexity of the seal between the free ink chamber and the negative pressure producing chamber in which the flexible tubing 68 runs through the free ink chamber 15.

In one exemplary embodiment of the present invention, the surface detection device 35 is a ballpoint roller that is in contact with a ballpoint sensor switch adapted to detect movement of the ballpoint contact sensor along a substrate. Upon such detection of movement, the sensor switch sends a signal to the power source and/or printhead, wherein jetting from the ink jet nozzles of the printhead can begin. In another embodiment of the present invention, the surface detection device 35 functions a pressure switch, wherein the pressure switch is adapted to determine the amount of force placed on the surface detection device by the user. The pressure sensor is connected to the power source and printhead. In one exemplary embodiment, the more force exerted by the user on the surface detection device 35, the frequency of the ink being jetting from the ink jet pen is increased. In a further embodiment, device 35 can also be a non-contact proximity sensor, such as infrared. The closer the sensor gets to the media, the greater the amount of ink ejected.

In one exemplary embodiment, the power source 40 is located on or in the free ink chamber 15. In one embodiment, electrical contacts can run from the free ink chamber 15 and the power source 40 to the printhead and other devices requiring power from the power source 40. Placement of the power source 40 on the free ink chamber 15 allows for easy replacement of the power source when the power source becomes depleted. In an alternative embodiment, the power source 40 is located near the surface detection device. In yet another alternative embodiment, the power source 40 is replaceable. For example, the ink jet pen may comprise a door or hatch or other opening to allow for removal and replacement of the power source 40. In yet another exemplary embodiment, the power source is configured to be rechargeable. Various recharging mechanisms are known to one skilled in the art. For example, in one embodiment, the ink jet pen is adapted to have at least a portion of the ink jet pen inserted into a recharging apparatus, such as a cradle. In another embodiment, a cable can be attached to the ink jet pen to recharge the power source 40.

The foregoing description of the various embodiments and principles of the invention has been presented for the purposes of illustration and description. It is not intended to be exhaustive or to limit the invention to the precise forms disclosed. Many alternatives, modifications and variations will be apparent to those skilled in the art. For example, some principals of the invention may be used in different ink jet pen configurations. Moreover, although multiple inventive concepts have been presented, such aspects need not be utilized in combination, and various combinations of inventive aspects are possible in light of the various embodiments provided above. Accordingly, the above description is intended to embrace all possible alternatives, modifications, combinations, and variations that have been discussed or suggested herein, as well as all others that fall within the principals, spirit and broad scope of the invention as defined by the claims.

What is claimed:

1. A hand-held inkjet pen comprising:

a printhead;

a pen body adapted to receive said printhead;

a negative pressure producing chamber disposed in said pen body at least partially filled with negative pressure producing material and adapted to contain ink at least partially absorbed within said negative pressure producing material;

a free ink chamber disposed in said pen body devoid of said negative pressure producing material and adapted to contain an ink supply; and a power source disposed in said pen body;

wherein said negative pressure producing chamber includes a supplemental free ink chamber, the supplemental free ink chamber disposed to be in fluid communication with said free ink chamber and said negative pressure producing material; and wherein said ink supply of said free ink chamber provides ink to said negative pressure producing chamber and said negative pressure producing chamber provides ink to said printhead.

2. The inkjet pen of claim 1, further comprising a surface detection device adapted to move along a surface of a substrate.

3. The inkjet pen of claim 2, wherein said surface detection device is adapted such that an ink jetting frequency is increased as the surface detection device moves closer to the substrate.

4. The inkjet pen of claim 2, wherein the surface detection device detects motion of the pen body, and wherein the surface detection device does not touch the substrate.

5. The inkjet pen of claim 1, wherein said printhead comprises a thermal ink jet printhead.

6. The inkjet pen of claim 1, wherein at least one of the free ink chamber and the negative pressure producing chamber is an interchangeable component of the pen.

7. The inkjet pen of claim 1, wherein the free ink chamber is adapted to connect to an auxiliary ink tank.

8. The inkjet pen of claim 1, wherein the negative pressure producing chamber includes a communication port that is configured to provide fluid communication between the free ink chamber and the negative pressure producing chamber.

9. The inkjet pen of claim 8, wherein the negative pressure producing chamber includes an air vent configured such that when a predetermined amount of ink is depleted from the negative pressure producing chamber an air pathway is established between the air vent and the free ink chamber allowing ink to flow from the free ink chamber into the negative pressure producing chamber.

10. The inkjet pen of claim 8, further comprising an air vent, and wherein the air vent comprises a tube in fluid communication with the negative pressure producing chamber and an exterior of the ink jet pen, and wherein the air vent is configured such that when a predetermined amount of ink is depleted from the negative pressure producing chamber an air pathway is established between the air vent and the free ink chamber allowing ink to flow from the free ink chamber into the negative pressure producing chamber.

11. The inkjet pen of claim 1, wherein the negative pressure producing chamber comprises a low capillary portion and a high capillary portion.

12. The ink jet pen of claim 1, further wherein at least a portion of the free ink chamber and the negative pressure producing chamber is disposed in the pen body.

13. The inkjet pen of claim 1, further comprising a seal between the free ink chamber and the negative pressure producing chamber.

14. The inkjet pen of claim 1, wherein the negative pressure producing chamber comprises a saturated region and an unsaturated region.

15. The inkjet pen of claim 1, wherein the free ink chamber further comprises a priming device adapted to prime flow of ink from the printhead.

16. The inkjet pen of claim 15, wherein the priming device comprises a diaphragm.

17. The inkjet pen of claim 1, wherein the free ink chamber further comprises an ink sensor adapted to monitor ink presence in the free ink chamber.

18. The inkjet pen of claim 1, wherein the surface detection device comprises a ball point that is adapted to detect movement of the inkjet pen along a surface of a substrate.

19. The ink jet pen of claim 1, wherein the supplemental free ink chamber is disposed in between the free ink chamber and the at least partially filled negative pressure producing material.

* * * * *